US008325122B2

(12) United States Patent
So

(10) Patent No.: US 8,325,122 B2
(45) Date of Patent: Dec. 4, 2012

(54) LIQUID CRYSTAL DISPLAY AND OVERDRIVE METHOD THEREOF

(75) Inventor: Hyun Jin So, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1392 days.

(21) Appl. No.: 12/000,240

(22) Filed: Dec. 11, 2007

(65) Prior Publication Data

US 2008/0158266 A1 Jul. 3, 2008

(30) Foreign Application Priority Data

Dec. 29, 2006 (KR) ..... 10-2006-138727

(51) Int. Cl.
*G09G 3/36* (2006.01)

(52) U.S. Cl. ..... 345/89; 345/690

(58) Field of Classification Search ..... 345/204–215, 345/87–104, 690–699; 323/299, 303, 349, 323/350, 351; 327/405, 407, 544
See application file for complete search history.

(56) References Cited

U.S. PATENT DOCUMENTS

| | | | | |
|---|---|---|---|---|
| 5,495,265 | A | 2/1996 | Hartman et al. | 345/87 |
| 6,377,234 | B1 * | 4/2002 | Nogawa | 345/89 |
| 6,567,066 | B1 * | 5/2003 | Hashimoto | 345/100 |
| 6,909,414 | B2 * | 6/2005 | Tsuchi et al. | 345/89 |
| 2003/0006979 | A1 * | 1/2003 | Tsuchi et al. | 345/204 |
| 2003/0085865 | A1 * | 5/2003 | Lee et al. | 345/98 |
| 2006/0017713 | A1 * | 1/2006 | Lee et al. | 345/204 |
| 2007/0296680 | A1 * | 12/2007 | Lee et al. | 345/100 |

FOREIGN PATENT DOCUMENTS

WO WO 99/05567 2/1999

* cited by examiner

*Primary Examiner* — Kevin M Nguyen
*Assistant Examiner* — Cory Almeida
(74) *Attorney, Agent, or Firm* — Morgan, Lewis & Bockius LLP

(57) ABSTRACT

A liquid crystal display including a timing controller generating a source output enable signal that controls the drive of an input data, and a data driving circuit modulating the input data to generate a modulation data, sequentially outputting the input data and the modulation data, and adjusting output periods of the input data and the modulation data based on a gray scale level of the input data.

53 Claims, 11 Drawing Sheets

FIG. 3
RELATED ART

LIQUID CRYSTAL DISPLAY AND OVERDRIVE METHOD THEREOF

The present invention claims the benefit of Korean Patent Application No. P2006-138727 filed in Korea on Dec. 29, 2006, which is hereby incorporated by reference.

BACKGROUND OF THE INVENTION

1. Field of the Invention

The present invention relates to a liquid crystal display, and more particularly to a liquid crystal display and an overdrive method thereof.

2. Discussion of the Related Art

In general, a liquid crystal display controls the light transmittance of liquid crystal cells using an electric field to display a picture. Liquid crystal displays include a thin film transistor substrate and a color filter substrate that are opposed to each other with a liquid crystal disposed therebetween.

To display a picture, a liquid crystal display typically controls the light transmittance of liquid crystal cells in accordance with video signals. An active matrix type liquid crystal display includes a switching device for each liquid crystal cell. The switching device typically employed in the active matrix liquid crystal display is a thin film transistor (TFT). The active matrix type liquid crystal display is advantageous for the display of a moving picture.

One disadvantage of the liquid crystal display is a slow response time resulting from inherent characteristics of the liquid crystal, such as viscosity, elasticity, etc. Such characteristics can be explained by the following EQUATIONS 1 and 2.

$$\tau_r \propto \frac{\gamma d^2}{\Delta\varepsilon |V_a^2 - V_F^2|} \quad \text{[EQUATION 1]}$$

Here, '$\tau_r$' represents a rising time when a voltage is applied to a liquid crystal, '$V_a$' represents an applied voltage, '$V_F$' represents a freederick transition voltage at which liquid crystal molecules begin to perform a tilt motion, 'd' represents a cell gap of the liquid crystal cell, and 'γ' represents a rotational viscosity of the liquid crystal molecules.

$$\tau_f \propto \frac{\gamma d^2}{K} \quad \text{[EQUATION 2]}$$

Here, '$\tau_f$' represents a falling time at which a liquid crystal is returned to an initial position by an elastic restoring force after a voltage applied to the liquid crystal is turned-off, and 'K' represents an elastic constant.

A twisted nematic (TN) mode liquid crystal has a different response time due to physical characteristics of the liquid crystal, cell gap, etc. Generally, the TN mode liquid crystal has a rising time between 20 ms to 80 ms and a falling time between 20 ms to 30 ms. As the TN mode liquid crystal has a response time that is longer than one frame interval of a moving picture (i.e., 16.67 ms in the case of NTSC system), a moving picture is displayed with a brightness lower than the corresponding value of video data VD as shown in FIG. 1. As a result, a motion blurring phenomenon occurs.

As illustrated in FIG. 1, the related art liquid crystal display cannot present the desired color and brightness. Because of the slow response time of the related art liquid crystal displays, display brightness BL fails to achieve a target brightness corresponding to changes in the video data VD from one level to another level. Accordingly, the motion-blurring phenomenon occurs, and display quality deteriorates due to a reduction in a contrast ratio.

In order to overcome the problems posed by the slow response time of the liquid crystal display, U.S. Pat. No. 5,495,265 and PCT International Publication No. WO 99/05567 have suggested modulating data by using a look-up table (hereinafter, referred to as "overdriving method"). This overdriving method allows data to be modulated as shown in FIG. 2.

Referring to FIG. 2, the overdriving method of the related art liquid crystal display modulates input data VD and applies the modulated data MVD to the liquid crystal cell to obtain a desired brightness MBL. The related art overdriving method modulates $|V_a^2 - V_F^2|$ from the above EQUATION 1 on the basis of a difference so that a desired brightness can be obtained. The desired brightness corresponds to a brightness value of the input data within one frame interval. In this manner, the response time of the liquid crystal is reduced. Accordingly, a liquid crystal display employing the related art overdriving method compensates for the slow response time of the liquid crystal by modulating the input data in order to alleviate the motion blurring phenomenon. As a result, an image having a desired color and a desired brightness can be displayed.

The overdriving method of the related art liquid crystal display compares uppermost bit data MSB of the previous frame Fn−1 with uppermost bit data MSB of the present frame Fn. If the uppermost bit data MSB are changed, the overdriving method selects a modulation data Mdata provided in a look-up table as shown in FIG. 3. Furthermore, the overdriving method of the liquid crystal display only modulates several upper bits so as to reduce a capacitance of a memory upon realizing the overdriving method as a hardware device.

A configuration of an overdrive device implementing the related art overdriving method is depicted in FIG. 4. Referring to FIG. 4, an overdrive device 100 includes a frame memory 130 and a look-up table 140. The frame memory 130 is connected to an upper bit bus line 120, and the look-up table 140 is connected to output terminals of the upper bit bus line 120 and the frame memory 130. The frame memory 130 stores the uppermost bit data MSB for one frame period and supplies the stored data to the look-up table 140. The uppermost bit data MSB includes the upper four bits of the eight bit source data RGB.

The look-up table 140 compares upper bit data MSB of the present frame Fn with upper bit data MSB of the previous frame Fn−1 according to TABLE 1 to select a corresponding modulation data Mdata. The upper bit data MSB of the present frame Fn is inputted from the upper bit bus line 120, and the upper bit data MSB of the previous frame Fn−1 is inputted from the frame memory 130. The modulation data Mdata is added to bit data LSB from a lower bit bus line 110 to be supplied to the related art liquid crystal display.

TABLE 1 is a look-up table in which the four bits corresponding to the upper bit data MSB are represented by base 10 numbers. The left column represents data voltage VDn−1 of the previous frame Fn−1, and an uppermost row represents a data voltage VDn of the present frame Fn.

TABLE 1

| Division | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | **0** | 1 | 3 | 4 | 6 | 7 | 9 | 10 | 11 | 12 | 14 | 15 | 15 | 15 | 15 | 15 |
| 1 | 0 | **1** | 2 | 4 | 5 | 7 | 9 | 10 | 11 | ***12*** | 13 | 14 | 15 | 15 | 15 | 15 |
| 2 | 0 | 1 | **2** | 3 | 5 | 7 | 8 | 9 | 10 | 12 | 13 | 14 | 15 | 15 | 15 | 15 |
| 3 | 0 | 1 | 2 | **3** | 5 | 6 | 8 | 9 | 10 | 11 | 12 | 14 | 14 | 15 | 15 | 15 |
| 4 | 0 | 0 | 1 | 2 | **4** | 6 | 7 | 9 | 10 | 11 | 12 | 13 | 14 | 15 | 15 | 15 |
| 5 | 0 | 0 | 0 | 2 | 3 | **5** | 7 | 8 | 9 | 11 | 12 | 13 | 14 | 15 | 15 | 15 |
| 6 | 0 | 0 | 0 | 1 | 3 | 4 | **6** | 8 | 9 | 10 | 11 | 13 | 14 | 15 | 15 | 15 |
| 7 | 0 | 0 | 0 | 1 | 2 | 4 | 5 | **7** | 8 | 10 | 11 | 12 | 14 | 14 | 15 | 15 |
| 8 | 0 | 0 | 0 | 1 | 2 | 3 | 5 | 6 | **8** | 9 | 11 | 12 | 13 | 14 | 15 | 15 |
| 9 | 0 | 0 | 0 | 1 | 2 | 3 | 4 | 6 | 7 | **9** | 10 | 12 | 13 | 14 | 15 | 15 |
| 10 | 0 | 0 | 0 | 0 | 1 | 2 | 4 | 5 | 7 | 8 | **10** | 11 | 13 | 14 | 15 | 15 |
| 11 | 0 | 0 | 0 | 0 | 0 | 2 | 3 | 5 | 6 | 7 | 9 | **11** | 12 | 14 | 15 | 15 |
| 12 | 0 | 0 | 0 | 0 | 0 | 1 | 3 | 4 | 5 | 7 | 8 | 10 | **12** | 13 | 15 | 15 |
| 13 | 0 | 0 | 0 | 0 | 0 | 1 | 2 | 3 | 4 | ***6*** | 8 | 10 | 11 | **13** | 14 | 15 |
| 14 | 0 | 0 | 0 | 0 | 0 | 0 | 1 | 2 | 3 | 5 | 7 | 9 | 11 | 13 | **14** | 15 |
| 15 | 0 | 0 | 0 | 0 | 0 | 0 | 0 | 1 | 2 | 4 | 6 | 9 | 11 | 13 | 14 | **15** |

The overdriving method of the related art liquid crystal display is more effective for reducing the liquid crystal response time when a gray scale is changed to a gray scale than when black is change to white. A change of the gray scale to gray scale has a lower voltage difference than a change from black to white. As a result, when the color is changed, the picture quality deteriorates.

Furthermore, the overdriving method of the related art liquid crystal display compares data of the previous frame Fn−1 with a data of the present frame Fn to generate modulation data MRGB. Since the overdrive device of the related art liquid crystal display includes a memory, such as a look-up table, manufacturing cost and chip size are increased.

SUMMARY OF THE INVENTION

Accordingly, the present invention is directed to a liquid crystal display and overdrive method thereof that substantially obviates one or more of the problems due to limitations and disadvantages of the related art.

It is another object of the present invention to provide a liquid crystal display and an overdriving method thereof that are adaptive for adjusting an output period of an input data and a modulated data in proportion to a gray scale level of a data inputted from a system to reducing a manufacturing cost and a volume of a product.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display and overdrive method thereof includes a liquid crystal display including a timing controller generating a source output enable signal that controls the drive of an input data, and a data driving circuit modulating the input data to generate a modulation data, sequentially outputting the input data and the modulation data, and adjusting output periods of the input data and the modulation data based on a gray scale level of the input data.

In another aspect, a overdriving method of a liquid crystal display includes the steps of generating a source output enable signal to drive an input data, and modulating the input data, in accordance with the source output enable signal, to generate a modulation data and then sequentially outputting the modulation data and the input data, output periods of the input data and the modulation data being adjusted based on a gray scale level of the input data.

In another aspect, a data driving circuit of a liquid crystal display includes a data processing means modulating an input data to generate a modulation data, and sequentially outputting the input data and the modulation data, and an output period adjusting means controlling output periods of the input data and the modulation data based on a gray scale level of the input data, the data processing means adjusting the output periods of the input data and the modulation data in accordance with a control of the output period adjusting means.

In another aspect, a method of driving a data of a liquid crystal display includes the steps of modulating an input data to generate a modulation data, and sequentially outputting the input data and the modulation data, the output periods of the input data and the modulation data being adjusted based on a gray scale level of the input data in the step of outputting the modulation data and the input data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 3 is a diagram showing a modulation of an upper bit data by the overdrive method of a related art liquid crystal display;

DETAILED DESCRIPTION OF THE PREFERRED EMBODIMENTS

Reference will now be made in detail to the preferred embodiments of the present invention, examples of which are illustrated in the accompanying drawings.

Figure 1:
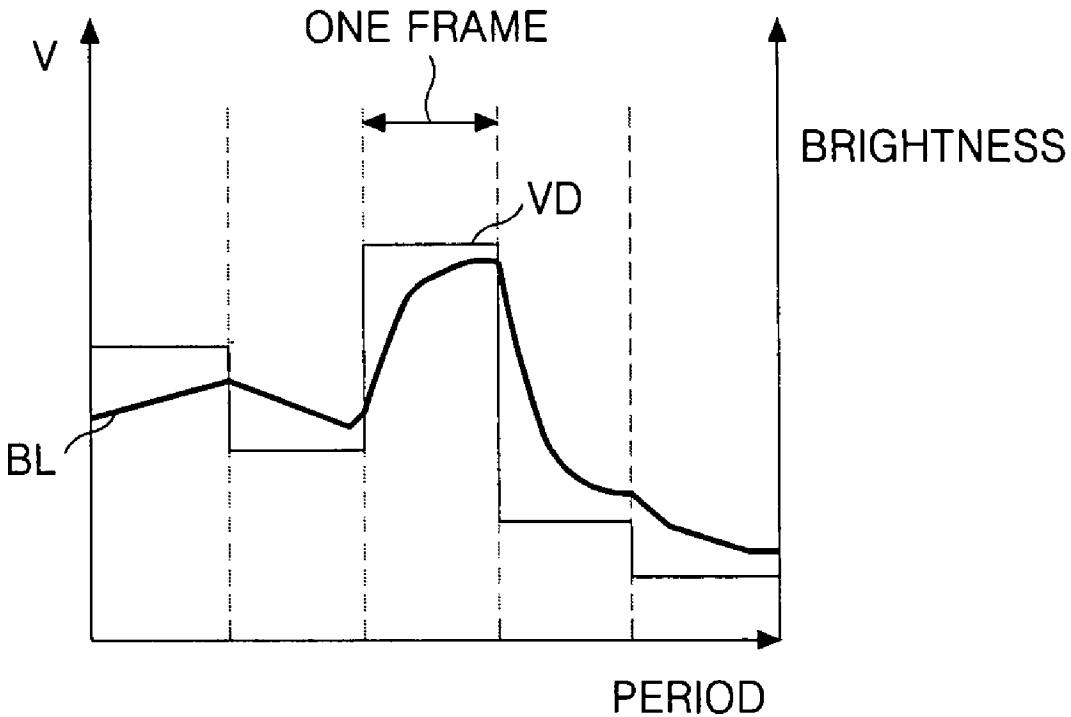
FIG. 1 RELATED ART
FIG. 1 is a waveform diagram comparing the display brightness and the video data in a related art liquid crystal display.
Figure 2:
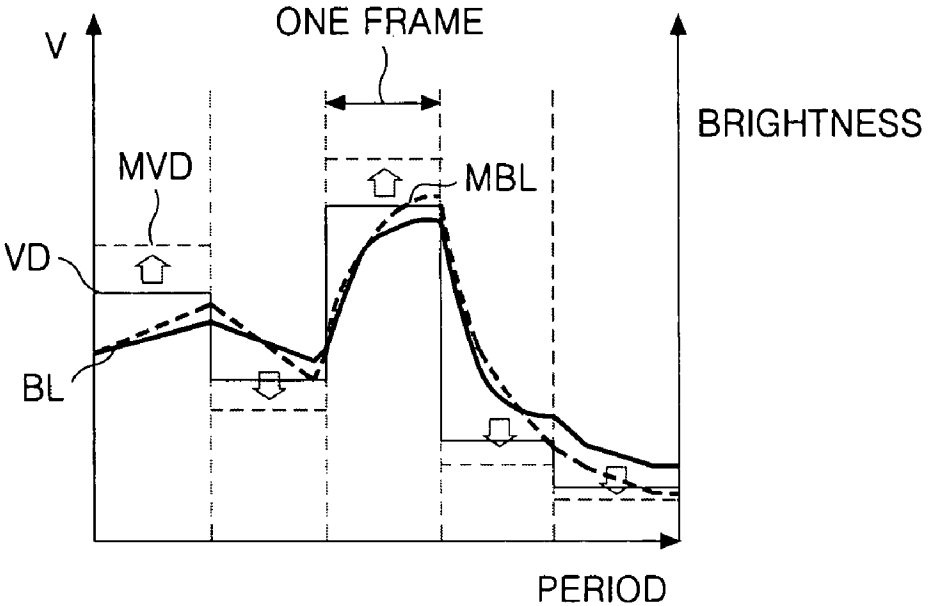
FIG. 2 RELATED ART
FIG. 2 is a waveform diagram comparing the desired brightness of a display and the modulated video data according to an overdrive method of a related art liquid crystal display.
Figure 4:
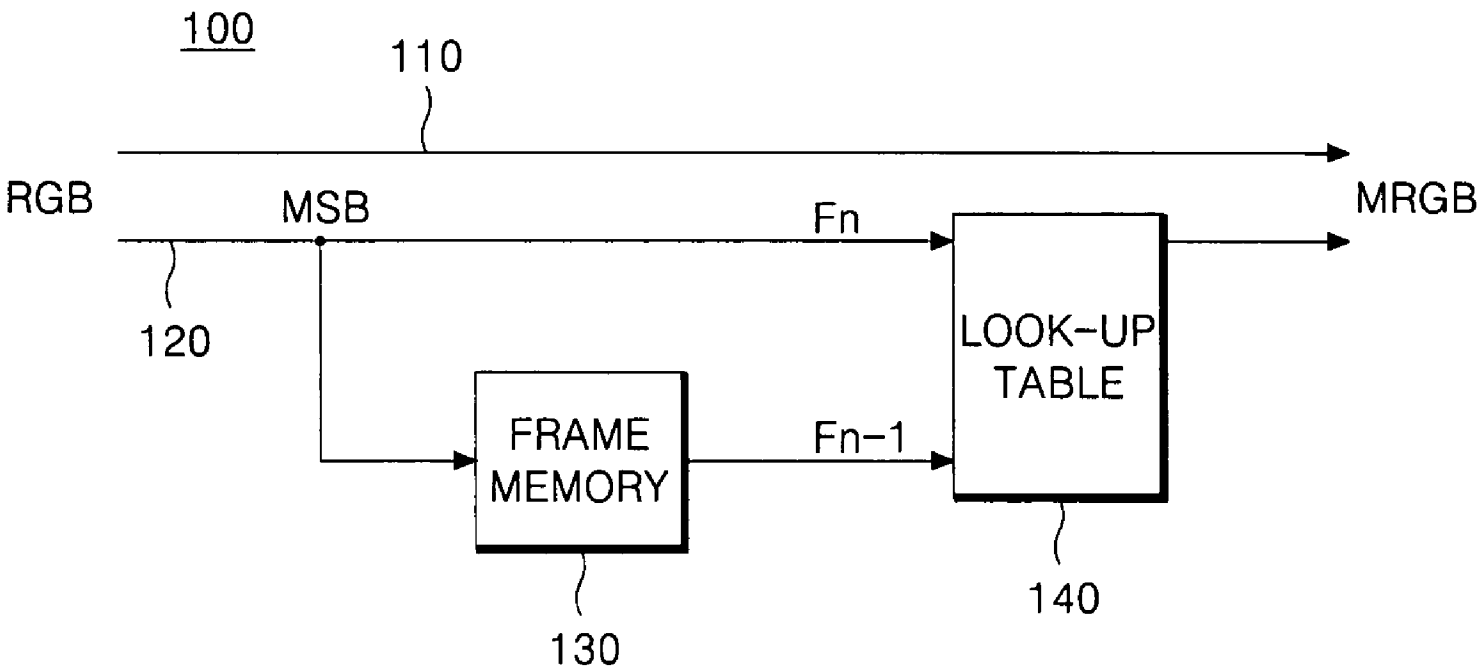
FIG. 4 RELATED ART
FIG. 4 is a diagram showing a configuration of an overdrive device of a related art liquid crystal display.
Figure 5:
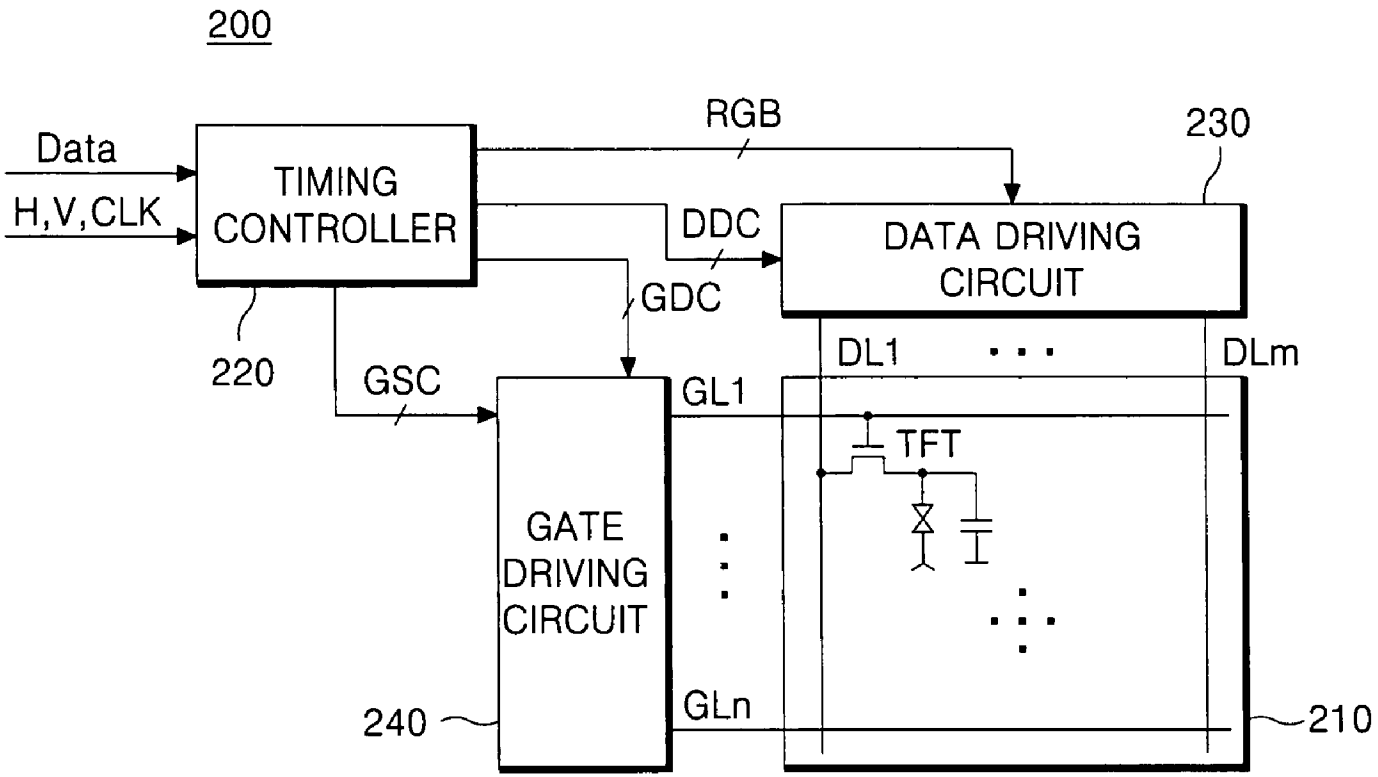
FIG. 5 is a diagram showing an exemplary configuration of a liquid crystal display according to an embodiment of the present invention.

FIG. 5 is a diagram showing an exemplary configuration of a liquid crystal display according to an embodiment of the present invention. Referring to FIG. 5, a liquid crystal display 200 includes a liquid crystal display panel 210, a timing controller 220, a data driving circuit 230, and a gate driving circuit 240. The liquid crystal display panel 210 has a thin film transistor (TFT) driving a liquid crystal cell Clc (not shown) formed at each crossing of data lines DL1 to DLm and gate lines GL1 to GLn. The timing controller 220 controls a data voltage with which the data lines DL1 to DLm are supplied. The timing controller 220 further controls a scanning pulse that is supplied to gate lines GL1 to GLn. The data driving circuit 230 converts digital data inputted from the timing controller 220 into an analog data voltage in accordance with a control of the timing controller 220. The analog data voltage is supplied to data lines DL1 to DLm. The gate driving circuit 240 sequentially supplies a scanning pulse to gate lines GL1 to GLn in accordance with a control of the timing controller 220.

In the liquid crystal display panel 210, a liquid crystal is injected between two glass substrates. The data lines DL1 to DLm and the gate lines GL1 to GLn cross each other on a lower glass substrate of the liquid crystal display panel 210. A TFT is formed at each crossing of data lines DL1 to DLm and gate lines GL1 to GLn. The TFT supplies data on the data lines DL1 to DLm to the liquid crystal cell Clc (not shown) in response to a scanning pulse. A gate electrode of the TFT is connected to the gate lines GL1 to GLn, and a source electrode of the TFT is connected to the data lines DL1 to DLm. A drain electrode of the TFT is connected to a pixel electrode of the liquid crystal cell Clc (not shown), and a storage capacitor Cst (not shown). The TFT is turned on by a scanning pulse supplied to a gate terminal via gate lines GL1 to GLn. Video data on data lines DL1 to DLm is supplied to the pixel electrode of the liquid crystal cell Clc (not shown) when the TFT is turned On.

Figure 6:
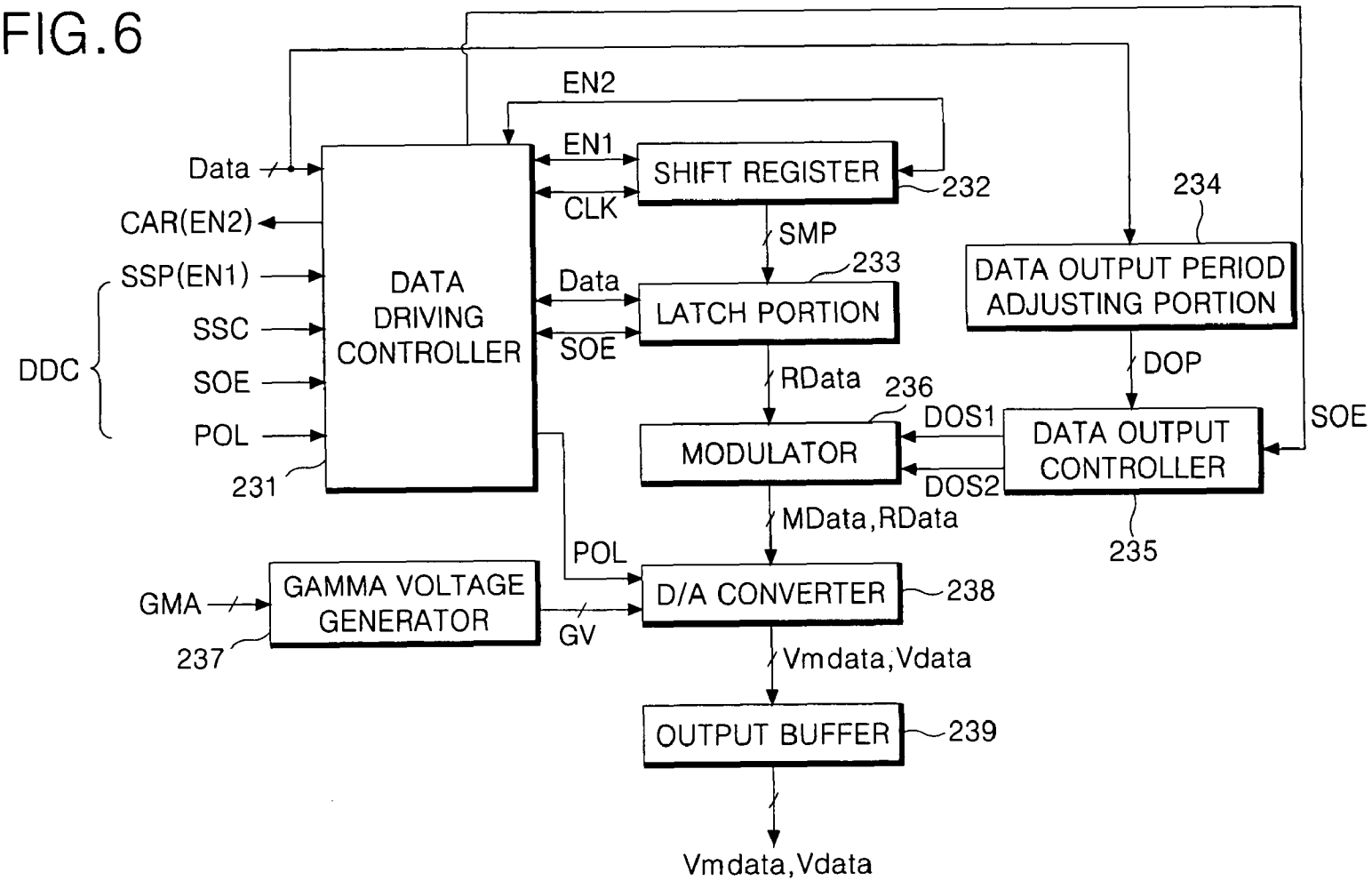
FIG. 6 is a diagram showing an exemplary configuration of the data driving circuit in FIG. 5.

The timing controller 220 supplies digital video data RGB to the data driving circuit 230. In addition, the timing controller 220 generates a data control signal DDC and a gate control signal GDC using horizontal/vertical synchronizing signals H and V in accordance with a clock signal CLK. The data control signal DDC and gate control signal GDC are supplied to the data driving circuit 230 and the gate driving circuit 240, respectively. As shown in FIG. 6, the data control signal DDC includes a source shift clock SSC, a source start pulse SSP, a polarity control signal POL, a source output enable signal SOE, etc. The gate control signal GDC includes a gate start pulse GSP, a gate output enable signal GOE, etc.

In response to the data control signal DDC, the data driving circuit 230 converts an i bits input data into an i-number of bits modulation data in accordance with at least two upper bits of the i-number of bits input data. The data control signal DDC and the i-number of bits input data are supplied by timing controller 220. Furthermore, the data driving circuit 230 sequentially converts both the i-number of bits modulation data and the i-number of bits input data into analog data voltages. Next, the data driving circuit 230 sequentially supplies an analog modulation data voltage by one horizontal line and an analog data voltage by one horizontal line to the data lines DL1 to DLm in an interval of one horizontal period 1H during which a scanning pulse is supplied to the gate lines GL1 to GLn.

The data driving circuit 230 also converts a polarity of the analog modulation data voltage and a polarity of the analog data voltage in response to a polarity control signal POL from the timing controller 220. Furthermore, the data driving circuit 230 adjusts the output periods of the analog modulation data voltage and the analog data voltage in proportion to a gray scale level of the data inputted from the timing controller 220. In this manner, the response time of the liquid crystal display is reduced.

The gate driving circuit 240 sequentially generates a scanning pulse, that is, a gate pulse in response to the gate driving control signal GDC and a gate shift clock GSC. The scanning pulse is supplied to the gate lines GL1 to GLn. The gate driving control signal GDC is supplied by the timing controller 220. The gate driving circuit 240 determines a high-level voltage and a low-level voltage of the scanning pulse in accordance with a gate high-level voltage VGH and a gate low-level voltage VGL. Here, the gate high-level voltage VGH and the gate low-level voltage VGL are supplied by a gate driving voltage generator (not shown).

FIG. 6 is a diagram showing an exemplary configuration of the data driving circuit in FIG. 5. Referring to FIG. 6, the data driving circuit 230 includes a data driving controller 231, a shift register 232, a latch portion 233, a data output period adjusting portion 234, a data output controller 235, a modulator 236, a gamma voltage generator 237, a D/A converter 238, and an output buffer 239.

The data driving controller 231 transmits the i-number of bits input data from the timing controller 220 to the latch portion 233. The data driving controller 231 transmits a first enable signal EN1 corresponding to the source start pulse SSP from the timing controller 220 and a clock signal CLK corresponding to the source shift clock SSC from the timing controller 220 to control a generation of a sampling signal SMP by shift register 232. The data driving controller 231 outputs a second enable signal EN2 corresponding to a carry signal CAR generated from the shift register 232.

The data driving controller 231 transmits the source output enable signal SOE from the timing controller 220 to the latch portion 233 to control a latch of a digital data. In addition, the data driving controller 231 transmits the source output enable signal SOE to the data output controller 235 to control output periods of a modulation data MData and a latch data RData. The data driving controller 231 transmits the polarity control signal POL from the timing controller 220 to the D/A converter 238 to control a polarity of an analog modulation data voltage Vmdata and a polarity of an analog data voltage Vdata. The analog modulation data voltage Vmdata and the analog data voltage Vdata are sequentially supplied to the data lines DL1 to DLm.

The shift register 232 sequentially shifts the first enable signal EN1 from the data driving controller 231 in accordance with the clock signal CLK to generate a sampling signal SMP.

Next, the shift register 232 supplies the sampling signal SMP to the latch portion 233 to control a latch of the digital data.

The latch portion 233 latches the i-number of bits input data by one horizontal line in accordance with the sampling signal SMP provided by shift register 232. The latch portion 233 supplies the latched i-number of bits of data RData of one horizontal line in accordance with the source output enable signal SOE to the modulator 233. Here, the i-number of bits input data and the source output enable signal SOE are supplied by the data driving controller 231.

The data output period adjusting portion 234 compares a gray scale level of the data inputted from the timing controller 220 with a predetermined reference gray scale level. In accordance with the result of the comparison, the data output period adjusting portion 234 supplies data output period data DOP to the data output controller 235. The data output period data DOP may be used to adjust the output periods of modulation data MData and latch data RData outputted by modulator 236.

Figure 7:
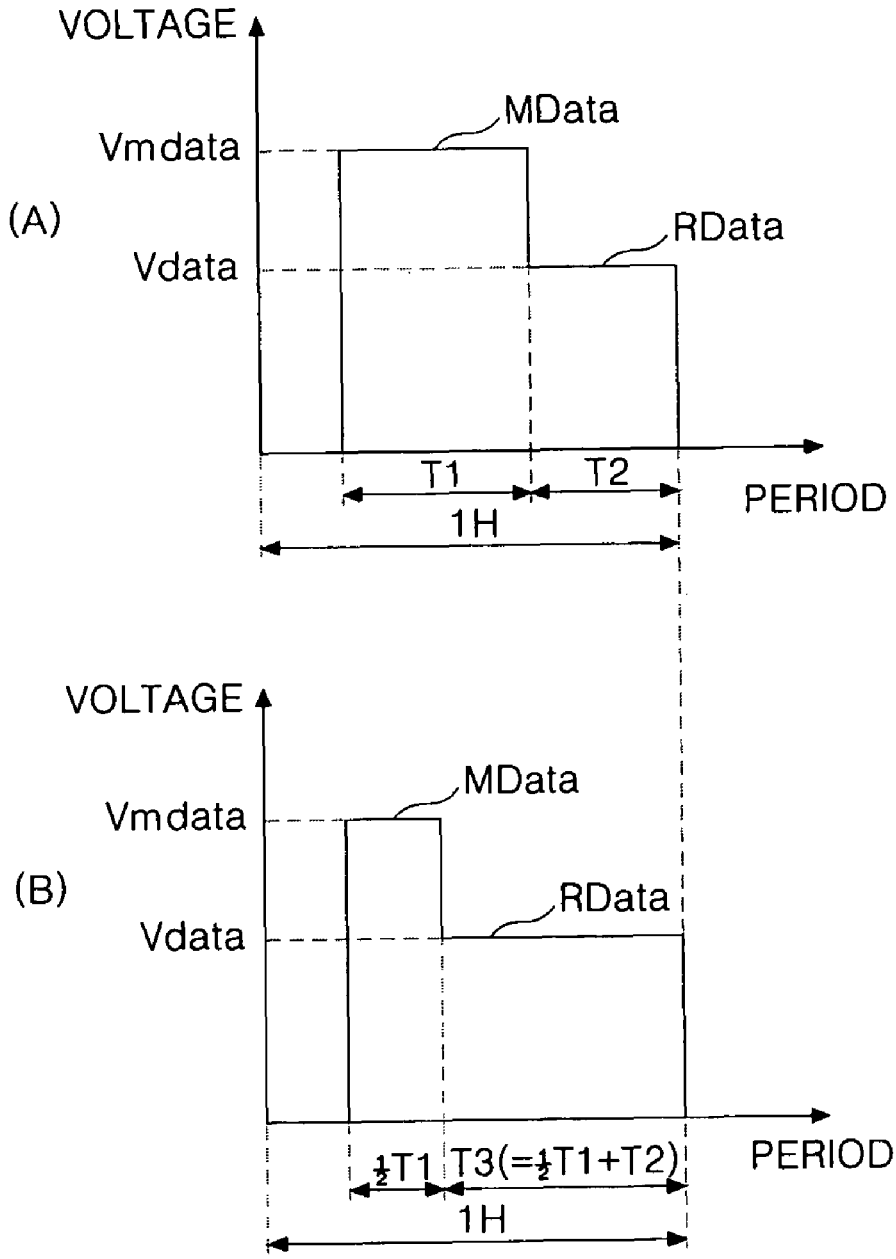
FIG. 7 is a diagram showing an output characteristics of the modulator in FIG. 6.

If the gray scale level of the inputted data is higher than the predetermined reference gray scale level, the data output period adjusting portion 234 supplies a data output period signal DOP to the data output controller 235 as shown in (A) of FIG. 7. In this case, the data output period signal DOP allows the output periods of the modulation data MData and the latch data RData outputted from the modulator 236 to have a slight difference or to be equal.

On the other hand, if the gray scale level of the inputted data is lower than the predetermined reference gray scale level, the data output period adjusting portion 234 supplies the data output period signal DOP to the data output controller 235 as shown in (B) of FIG. 7. In this case, the data output period signal DOP allows an output period of the modulation data MData outputted from the modulator 236 to be decreased by as much as about a half period and, simultaneously allows an output period of the latch RData outputted from the modulator 236 to be increased by as much as the decreased period. The predetermined reference gray scale level may be a middle gray scale level of the data inputted from a system.

Figure 8A:
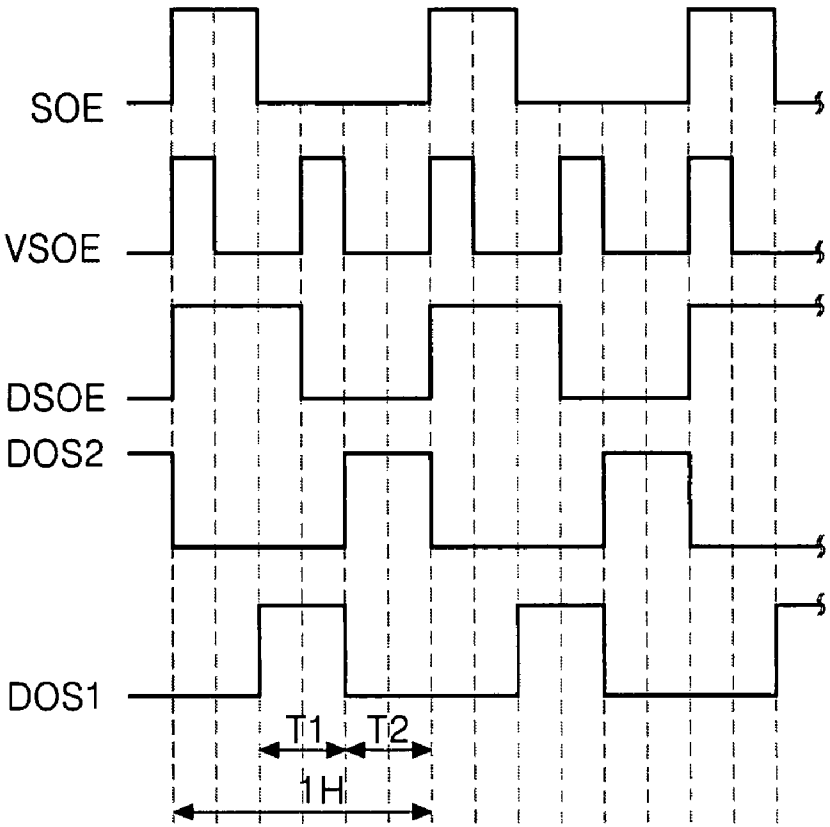
FIG. 8A and FIG. 8B are diagrams showing a characteristics of a signal generated by the data output controller in FIG. 6.

When the data output period signal DOP is inputted, the data output controller 235 sequentially generates a first data output signal DOS1 and a second data output signal DOS2. The first data output signal DOS1 and the second data output signal DOS2 are supplied to the modulator 236 as shown in FIG. 8A.

If the data output period signal DOP allows the output periods of the modulation data MData and the latch data RData to be approximately equal, the first data output signal DOS1 and the second data output signal DOS2 have the same high-level width. In this case, the first data output signal DOS1 allows the modulation data MData to be outputted from the modulator 236 for a high-level interval, and the second data output signal DOS2 allows the latch data RData to be outputted from the modulator 236 for the high-level interval.

Figure 8B:
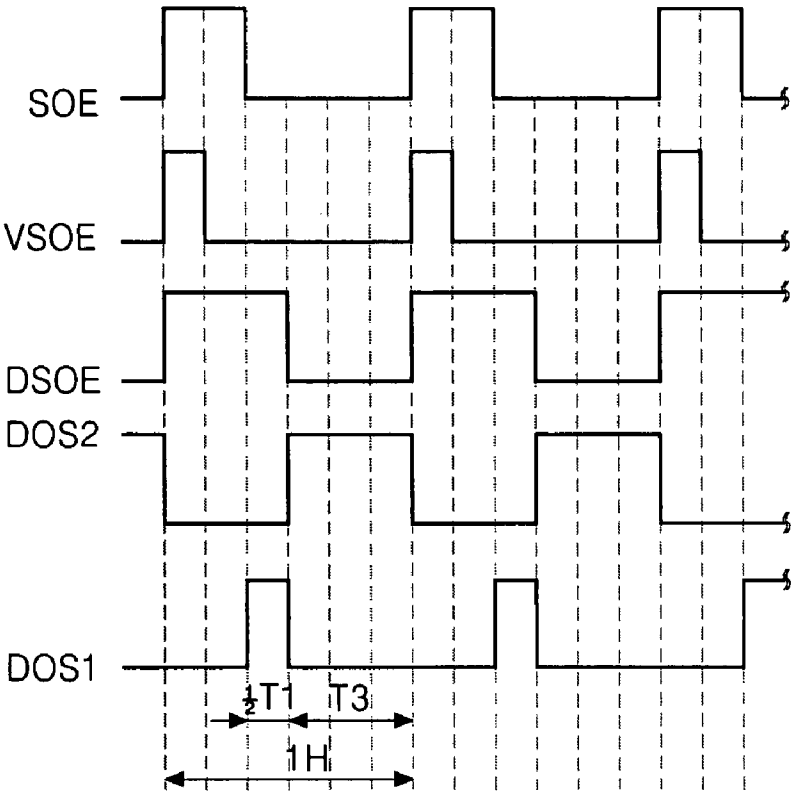

If the data output period signal DOP allows the output period of the modulation data MData to be decreased, and allows the output period of the latch RData to be increased by as much as the decreased period, the data output controller 235 may decrease the high-level width of the first data output signal DOS1 by as much as a half width, and simultaneously increase the high-level width of the second data output signal DOS2 by as much as the decreased high-level width. The first data output signal DOS1 and the second data output signal DOS2 are sequentially supplied to the modulator 236, as shown in FIG. 8B. In this case, the data output period signal DOP allows an output period of the modulation data MData to be decreased by as much as about a half period and, at the same time allows an output period of the latch RData to be increased by as much as the decreased period.

The modulator 236 receives latched data RData, and generates the modulation data MData. In accordance with the first and second data output signals DOS1 and DOS2 from the data output controller 235, the modulator 236 sequentially outputs the modulation data MData and the latch data RData to the D/A converter 238.

When the first and second data output signals DOS1 and DOS2 having the same high-level width are sequentially inputted, as shown in FIG. 8A, the modulator 236 outputs the modulation data MData to the D/A converter 238 in response to the first data output signal DOS1 for the T1 interval, and then outputs the latch data RData to the D/A converter 238 in response to the second data output signal DOS2 for the T2 interval, as shown in (A) of FIG. 7. In this case, the time widths of the T1 interval and the T2 interval are approximately equal, and are included in one horizontal period 1H. One horizontal period 1H corresponds to one period of the source output enable signal SOE.

When the first data output signal DOS1 having a high-level width of a T1/2 period and the second data output signal DOS2 having a high-level width of a T3(T1/2+T2) period are sequentially inputted as shown in FIG. 8B, the modulator 236 outputs the modulation data MData to the D/A converter 238 in response to the first data output signal DOS1 during a T1/2 period and then sequentially outputs the latch data RData to the D/A converter 238 in response to the second data output signal DOS2 during a T3 period, as shown in (B) of FIG. 7. A time width of the T3 period is three times as wide as the T1/2 period.

The gamma voltage generator 237 divides different level gamma reference voltages GMA supplied by a gamma reference voltage generator (not shown) to correspond to the number of i bits gray scale. Next, the gamma voltage generator 237 generates 2i gamma voltages GV to supply them to the D/A converter 238.

The D/A converter 238 converts the modulation data MData and the latch data RData into an analog modulation data voltage Vmdata and an analog data voltage Vdata using the 2i gamma voltages. The 2i gamma voltages are supplied from the gamma voltage generator 237, and the modulation data MData and the latch data RData are sequentially inputted from the modulator 236. The D/A converter 238 adjusts the polarity of the analog modulation data voltage Vmdata and the polarity of the analog data voltage Vdata in accordance with the polarity control signal POL. The polarity control signal POL is inputted to the D/A converter 238 by the data driving controller 231. The modulation data MData and the latch data RData are then sequentially supplied to the output buffer 239. The output buffer 239 stores the analog modulation data voltage Vmdata and the analog data voltage Vdata to sequentially supply them to the data lines DL1 to DLm.

Figure 9:
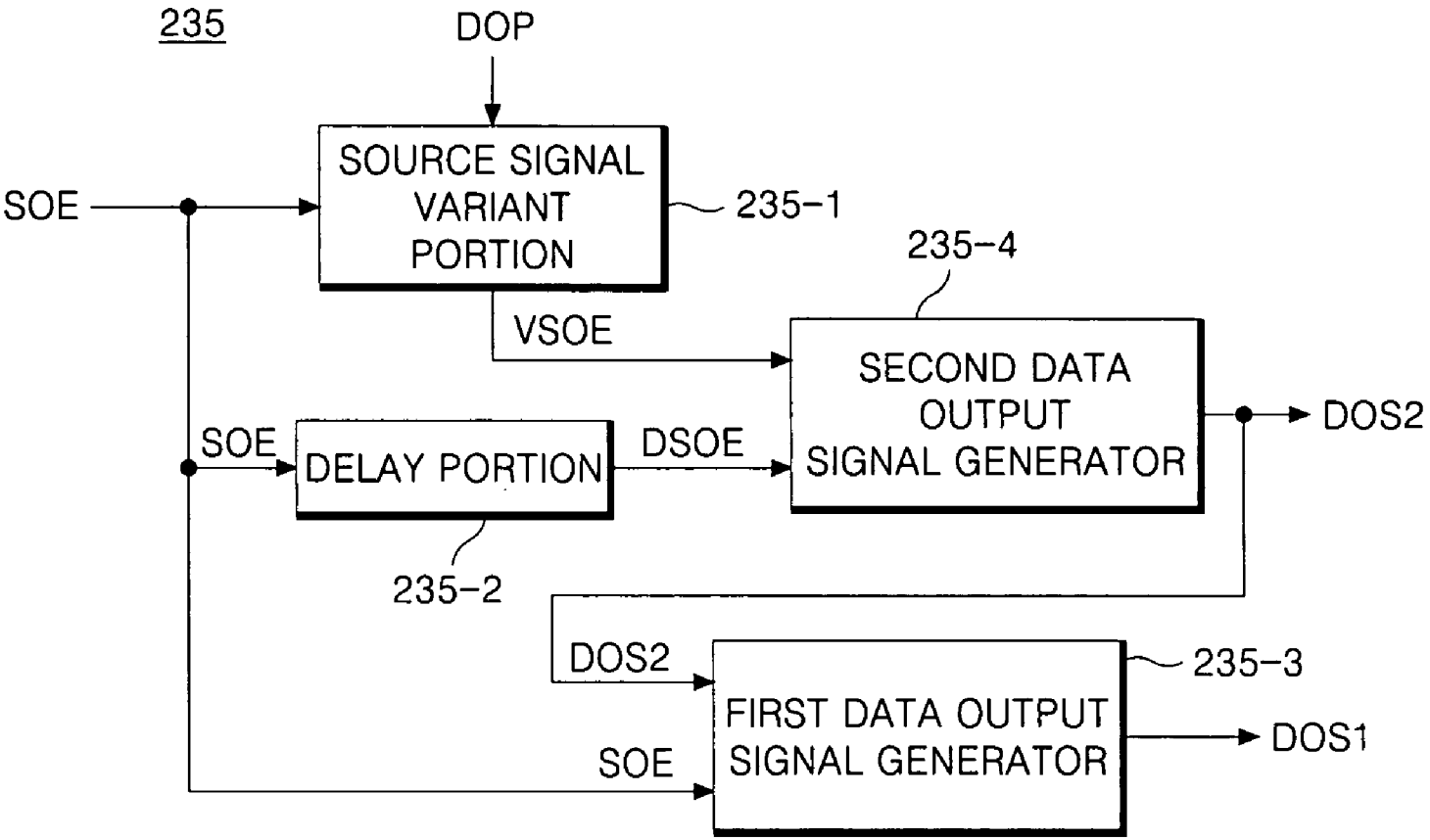
FIG. 9 is a diagram showing an exemplary configuration of the data output controller in FIG. 6.

FIG. 9 is a diagram showing an exemplary configuration of the data output controller in FIG. 6. Referring to FIG. 9, the data output controller 235 includes a source signal variant portion 235-1, a delay portion 235-2, a first data output signal generator 235-3, and a second data output signal generator 235-4.

When the data output period signal DOP is inputted from the data output period adjusting portion 234, the source signal variant portion 235-1 outputs a variable source output enable signal VSOE to the second data output signal generator 235-4. The data output period signal DOP allows the output periods of the modulation data MData and the latch data RData to be approximately equal. A frequency of the source output enable signal SOE inputted via the data driving controller 231 is multiplied by a factor of two to decrease a period of the source output enable signal SOE by a half period, thereby obtaining the variable source output enable signal VSOE as shown in FIG. 8A.

When the data output period signal DOP is inputted from the data output period adjusting portion 234, the source signal variant portion 235-1 outputs a variable source output enable signal VSOE to the second data output signal generator 235-4. The data output period signal DOP allows the output period of the modulation data MData to be decreased as shown in FIG. 7(B). The high-level width of the source output enable signal SOE inputted via the data driving controller 231 is reduced by a half width to obtain the variable source output enable signal VSOE as shown in FIG. 8B. Herein, the source signal variant portion 235-1 changes from a middle portion to a falling edge of a high-level interval of the source output enable signal SOE in a low-level.

The delay portion 235-2 delays a high-level interval of the source output enable signal SOE inputted via the data driving controller 231 to output the delayed source output enable signal DSOE to the second data output signal generator 235-4. Referring to FIG. 8A and FIG. 8B, the delay portion 235-2 delays a high-level interval by as much as a half interval of the high-level interval of the inputted source output enable signal SOE. Accordingly, the high-level interval of the source output enable signal SOE may be amplified by as much as a half interval. The delay portion 235-2 then outputs a delay source output enable signal DSOE having the amplified high-level interval to the second data output signal generator 235-4.

The first data output signal generator 235-3 is comprised of a NORGATE (not shown) having two input terminals and an output terminal. The two input terminals are inputted with the source output enable signal SOE from the data driving controller 231 and the second data output signal DOS2 from the second data output signal generator 235-4. The output terminal outputs the first data output signal DOS1. If the signals inputted via the two input terminals are both low-level, the NORGATE outputs the high-level signal. Otherwise, the NORGATE outputs a low-level signal.

The first data output signal generator 235-3 performs a nor operation on the inputted second data output signal DOS2 and the inputted source output enable signal SOE to output the first data output signal DOS1. In this case, the first data output signal is DOS1 maintained as a high-level to the modulator 236 for the T1 interval prior to the T2 interval of the interval of one horizontal period 1H. And, the second data output signal DOS2 is maintained as a high-level for the T2 interval of the interval of one horizontal period 1H, and is maintained as a low-level for an, interval other than the T1 interval and the T2 interval as shown in FIG. 8A. Since a low-level of the inputted source output enable signal SOE overlaps with a low-level of the second data output signal DOS2 at only T1 interval of the interval of one horizontal period 1H, the first data output signal generator 235-3 outputs the first data output signal DOS1 which is maintained as a high-level for the T1 interval. Furthermore, since a low-level of the inputted source output enable signal SOE does not overlap with a low-level of the second data output signal DOS2 at an interval other than the T1 interval of the interval of one horizontal period 1H, the first data output signal generator 235-3 outputs the first data output signal DOS1 which is maintained as a low-level during the T1 interval.

The first data output signal generator 235-3 performs a nor operation on the inputted second data output signal DOS2 and the inputted source output enable signal SOE to output the first data output signal DOS1. In another case, the first data output signal DOS1 maintained as a high-level to the modulator 236 for the T1/2 interval prior to the T3 interval of the interval of one horizontal period 1H. And, the second data output signal DOS2 is maintained as a high-level for the T3 interval of the interval of one horizontal period 1H, and is maintained as a low-level for the T1/2 interval and an interval other than the T2 interval as shown in FIG. 8B. Since a low-level of the inputted source output enable signal SOE overlaps with a low-level of the second data output signal DOS2 at only T1/2 interval of the interval of one horizontal period 1H, the first data output signal generator 235-3 outputs the first data output signal DOS1 which is maintained as a high-level for the T1/2 interval. Furthermore, since a low-level of the inputted source output enable signal SOE is not overlapped with a low-level of the second data output signal DOS2 at an interval other than the T1/2 interval of the interval of one horizontal period 1H, the first data output signal generator 235-3 outputs the first data output signal DOS1 which is maintained as a low-level.

The second data output signal generator 235-4 is comprised of a NORGATE (not shown) having two input terminals and an output terminal. The two input terminals are inputted with the variable source output enable signal VSOE from the source signal variant portion 235-1 and the delay source output enable signal DSOE from the delay portion 235-2. The output terminal outputs the second data output signal DOS2.

If the variable source output signal VSOE is inputted as shown in FIG. 8A, the second data output signal generator 235-4 operates a nondisjunction of the variable source output enable signal VSOE and the inputted delay source output enable signal DSOE to output the second data output signal DOS2 maintained as a high-level to the first data output signal generator 235-3 and the modulator 236 for the T2 interval delay the T1 interval of the interval of one horizontal period 1H. In this case, the variable source output enable signal VSOE has a period which is decreased by a frequency multiply. Herein, since a low-level of the inputted variable source output enable signal VSOE is overlapped with a low-level of the delay source output enable signal DSOE at only T2 interval of the interval of one horizontal period 1H, the second data output signal generator 235-4 outputs the second data output signal DOS2 which is maintained as a high-level for T2 interval. Furthermore, since a low-level of the inputted variable source output enable signal VSOE is not overlapped with a low-level of the delay source output enable signal DSOE at an interval other than the T2 interval of the interval of one horizontal period 1H, the second data output signal generator 235-4 outputs the second data output signal DOS2 which is maintained as a low-level. Herein, a T3 period is comprised of the T2 interval and the T1/2 interval.

The variable source output signal VSOE is inputted, the second data output signal generator 235-4 operates a nondisjunction of the variable source output enable signal VSOE and the inputted delay source output enable signal DSOE to output the second data output signal DOS2 maintained as a high-level to the first data output signal generator 235-3 and the modulator 236 for the T3 interval of the interval of one horizontal period 1H. In this case, the variable source output enable signal VSOE has the decreased high-level width as shown in FIG. 8B. Herein, since a low-level of the inputted variable source output enable signal VSOE is overlapped with a low-level of the delay source output enable signal DSOE at only T3 interval of the interval of one horizontal period 1H, the second data output signal generator 235-4 outputs the second data output signal DOS2 which is maintained as a high-level for T3 interval. Furthermore, since a low-level of the inputted variable source output enable signal VSOE is not overlapped with a low-level of the delay source output enable signal DSOE at an interval other than the T3 interval of the interval of one horizontal period 1H, the second data output signal generator 235-4 outputs the second data output signal DOS2 which is maintained as a low-level.

As described above, the first and second data output signal generators 235-3 and 235-4 output the first and second data output signals DOS1 and DOS2 by the interval of one horizontal period 1H. More specifically, since a high-level interval of the first data output signal DOS1 of the interval of one horizontal period 1H is supplied to the modulator 236 and then a high-level interval of the second data output signal DOS2 is supplied to the modulator 236, the modulation data MData outputted from the modulator 236 at the high-level interval of the first data output signal DOS1 and then the latch data RData is outputted from the modulator 236 at a high-level interval of the second data output signal DOS2. Herein, if high-level widths of the first and second data output signals DOS1 and DOS2 are the same each other as shown in FIG. 8A, the output periods of the modulation data MData and the latch data RData have a slight difference or have the same each other as shown in (A) of FIG. 7. On the other hand, if a high-level width (T3 interval) of the second data output signal DOS2 is three times as wide as a high-level width (T1/2 interval) of the first data output signal DOS1 as shown in FIG. 8B, an output period of the latch data RData is three times as long as an output period of the modulation data MData as shown in (B) of FIG. 7.

Figure 10:
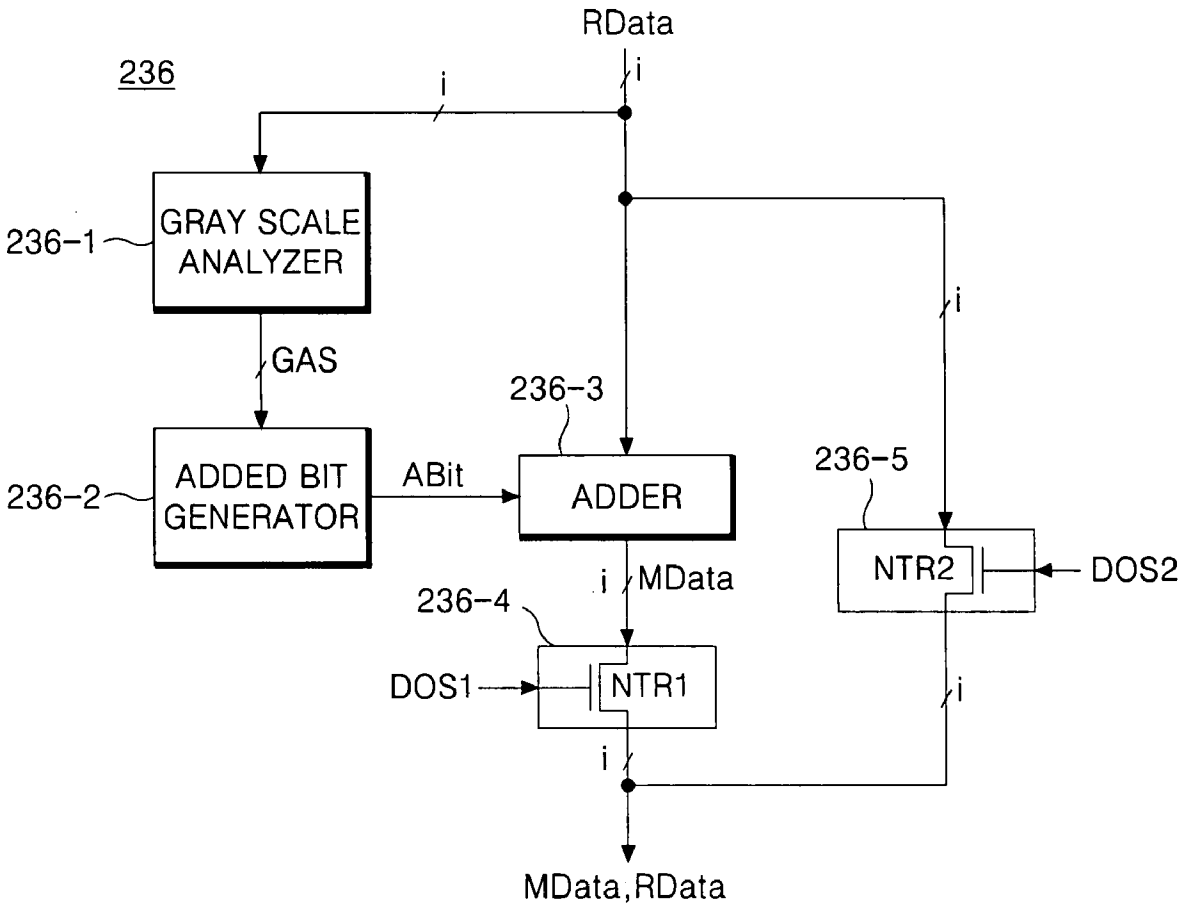
FIG. 10 is a diagram showing an exemplary configuration of the modulator in FIG. 6.

FIG. 10 is a diagram showing an exemplary configuration of the modulator in FIG. 6. Referring to FIG. 10, the modulator 236 includes a gray scale analyzer 236-1, an added bit generator 236-2, an adder 236-3, a first output portion 236-4, and a second output portion 236-5.

The gray scale analyzer 236-1 analyses at least the upper two bits (j bits) of i bits latch data RData from the latch portion 233 to supply a gray scale analyzing signal GAS to the added bit generator 236-2. For example, the gray scale analyzer 236-1 generates the gray scale analyzing signal GAS in accordance with upper two bits e bits) of the i bits latch data RData from the latch portion 233 as shown in the following TABLE 2.

TABLE 2

| Upper two bits (j bits) | Gray scale analyzing signal (GAS) |
|---|---|
| 00 | 0 |
| 01 | 1 |
| 10 | 2 |
| 11 | 3 |

The added bit generator 236-2 generates an added bit ABit of at least two bits in accordance with the gray scale analyzing signal GAS from the gray scale analyzer 236-1. The added bit Abit is then supplied supply the adder 236-3.

For example, if the value of gray scale analyzing signal GAS is '0' or '3', the added bit generator 236-2 generates an added bit ABit of '001', and if the value of gray scale analyzing signal GAS is '1' or '2', the added bit generator 236-2 generates an added bit ABit of '010' as shown in the following table 3. The added bit ABit is not limited to the following TABLE 3, and can be set in accordance with a resolution of a liquid crystal display panel 210 and a mode of driving the liquid crystal cell.

TABLE 3

| Gray scale analyzing signal (GAS) | Added bit (ABit) |
|---|---|
| 0 | 001 |
| 1 | 010 |
| 2 | 010 |
| 3 | 001 |

The adder 236-3 adds an added bit ABit of at least two bits from the added bit generator 236-2 to an upper bit of the i bits latch data RData from the latch portion 233 to generate i bits modulation data MData. The modulation data MData is then supplied to the first output portion 236-4. Accordingly, a gray scale value of the i bits modulation data MData is larger than that of the i bits latch data RData.

The first output portion 236-4 is comprised of a NMOS transistor NTR1 having a gate, a drain, and a source. The gate is connected to an output terminal of the first data output signal generator 235-3. Accordingly, the first data output signal DOS1 is applied to the gate. The source is connected to an output terminal of the adder 236-3. The drain is connected to an input terminal of the D/A converter 238. The NMOS transistor NTR1 of the first output portion 236-4 is turned-on at a high-level interval of the first data output signal DOS1 to output the i bits modulation data MData from the adder 236-3 to the D/A converter 238.

The second output portion 236-5 is comprised of a NMOS transistor NTR2 having a gate, a drain, and a source. The gate is connected to an output terminal of the second data output signal generator 235-4. Accordingly, the second data output signal DOS2 is applied to the gate. The source is connected to an output terminal of the latch portion 233. The drain is connected to an input terminal of the D/A converter 238. The NMOS transistor NTR2 of the second output portion 236-5 is turned-on at a high-level interval of the second data output signal DOS2 to output the i bits latch data RData from the latch portion 233 to the D/A converter 238.

The modulator 236 converts the i bits latch data RData into the i bits modulation data MData in accordance with at least the upper two bits of the i bits latch data RData supplied from the latch portion 233. Use of the i bit modulation data MData reduces the response time of the liquid crystal display. Furthermore, the modulator 236 outputs the i bits modulation data MData to the D/A converter 238 in accordance with the first data output signal DOS1 of high-level and then sequentially outputs the i bits latch data RData to the D/A converter 238 in accordance with the second data output signal DOS2 of high-level.

For example, if a latch data RData of '011000' is supplied from the latch portion 233, the modulator 236 generates an added bit ABit of '010' in accordance with a gray scale analyzing signal GAS of '1' corresponding to upper two bits of '01' of the latch data RData of '011000'. The modulator 236 adds the added bit ABit of '010' to upper three bits of the latch data RData of '011000' to generate a modulation data MData of '101000'.

After the modulation data MData of '101000' is generated, the modulator 236 outputs the modulation data MData of '101000' to the D/A converter 238 at a high-level interval of the first data output signal DOS1. The modulator 236 then outputs the latch data RData of '011000' to the D/A converter 238 at a high-level interval of the second data output signal DOS2. Modulation data MData and latch data RData are sequentially inputted to the D/A converter 238 as shown in FIG. 7.

When the high-level widths of the first and second data output signals DOS1 and DOS2 are the same as each other as shown in FIG. 8A, the modulator 236 outputs the modulation data MData of '101000' to the D/A converter 238 during the T1 interval of the one horizontal period 1H. The modulator 236 then outputs the latch data RData of '011000' to the D/A converter 238 during the T2 interval as shown in (A) of FIG. 7. In this case, the T1 and T2 intervals are of approximately equal duration.

On the other hand, when a high-level width (T3 interval) of the second data output signal DOS2 is three times as wide as a high-level width (T1/2 interval) of the first data output signal DOS1 as shown in FIG. 8B, the modulator 236 outputs the modulation data MData of '101000' to the D/A converter 238 for the T1/2 interval of the one horizontal period 1H and then outputs the latch data RData of '011000' to the D/A converter 238 for the T3 interval as shown in (B) of FIG. 7. In this case, the duration of the T3 interval is three times as long as the T1/2 interval.

Accordingly, when the high-level widths of the first and second data output signals DOS1 and DOS2 are the same each other as shown in FIG. 8A, the output buffer 239 stores the analog modulation data voltage Vmdata. The output buffer 239 supplies the analog modulation data voltage Vmdata to the lines DL1 to DLm during the T1 interval of the one horizontal period 1H. The output buffer 239 then stores the analog data voltage Vdata. The output buffer 239 supplies the analog data voltage Vdata to data lines DL1 to DLm during the T2 interval having the same period as the T1 interval as shown in (A) of FIG. 7.

On the other hand, when a high-level width (T3 interval) of the second data output signal DOS2 is three times as wide as a high-level width (T1/2 interval) of the first data output signal DOS1 as shown in FIG. 8B, the output buffer 239 stores the analog modulation data voltage Vmdata. The output buffer 239 supplies the analog modulation data voltage Vmdata to data lines DL1 to DLm during the T1/2 interval of the one horizontal period 1H. The output buffer 239 then stores the analog data voltage Vdata to supply it to the data lines DL1 to DLm for the T3 interval as shown in (B) of FIG. 7. Here, the T3 interval is three times as long as the T1/2 interval.

As described above, the present invention supplies the analog modulation data voltage Vmdata to the liquid crystal cells during the T1 interval or the T1/2 interval of one horizontal period 1H. The one horizontal period 1H corresponds to one period of the source output enable signal SOE. Next, the present invention supplies the analog data voltage Vdata to the liquid crystal cells during the T2 interval or the T3 interval of one horizontal period 1H.

As described above, the present invention adjusts an output period of an input data and a modulated data in proportion to a gray scale level of a data inputted from a system without using an additional look-up table and an additional memory. Hence, the manufacturing cost is decreased and the volume of the product is reduced. Furthermore, the present invention reduces the response time of the liquid crystal display regarding a middle gray scale. Accordingly, picture quality is improved.

It will be apparent to those skilled in the art that various modifications and variations can be made in the liquid crystal display and overdrive method thereof of the present invention without departing from the spirit or scope of the invention. Thus, it is intended that the present invention cover the modifications and variations of this invention provided they come within the scope of the appended claims and their equivalents.

What is claimed is:

1. A liquid crystal display, comprising:

a timing controller generating a source output enable signal that controls the drive of an input data; and a data driving circuit modulating the input data to generate a modulation data, sequentially outputting the input data and the modulation data, and adjusting output periods of the input data and the modulation data based on a gray scale level of the input data.

2. The liquid crystal display according to claim 1, wherein the data driving circuit includes:

a latch portion latching the input data to generate latch data;

a data output period adjusting portion generating a data output period signal to adjust output periods the latch data and the modulation data based on a gray scale level of the input data;

a data output controller generating first and second data output signals to control a sequential output of the modulation data and the latch data, and to indicate output periods of the modulation data and the latch data; and a modulator modulating the latch data to generate the modulation data, sequentially outputting the modulation data and the latch data in accordance with the first and second data output signals, and adjusting output periods of the modulation data and the latch data.

3. The liquid crystal display according to claim 2, wherein the data output period adjusting portion compares the input data with a predetermined reference gray scale level to generate the data output period signal.

4. The liquid crystal display according to claim 3, wherein if a gray scale level of the input data is higher than the predetermined reference gray scale level, the data output period adjusting portion supplies the data output period signal indicating that output periods of the latch data and the modulation data are approximately equal.

5. The liquid crystal display according to claim 3, wherein if a gray scale level of the input data is lower than the predetermined reference gray scale level, the data output period adjusting portion supplies the data output period signal indicating to decrease output period of the modulation data and increase the output period of the latch data.

6. The liquid crystal display according to claim 2, wherein the data output controller includes:

a source signal variant portion changing a period of the source output enable signal to output a first variable source output enable signal or changing a high-level width of the source output enable signal to output a second variable source output enable signal;

a delay portion delaying a source output enable signal from the timing controller to output a delay source output enable signal;

a first data output signal generator generating the first data output signal which indicates an output of the modulation data using the source output enable signal and a second data output signal; and a second data output signal generator generating the second data output signal which indicates an output of the latch data using the delay source output enable signal and one of the first and second variable source output enable signals.

7. The liquid crystal display according to claim 6, wherein the source signal variant portion outputs the first variable source output enable signal when a frequency of the source output enable signal is multiplied by a factor of two in accordance with the data output period signal indicating an output period increase of the modulation data to the second data output signal generator.

8. The liquid crystal display according to claim 7, wherein the second data output signal generator performs a nor operation on the first variable source output enable signal and the delay source output enable signal to output the second data output signal.

9. The liquid crystal display according to claim 8, wherein the first data output signal generator performs a nor operation on the second data output signal and the source output enable signal to output the first data output signal.

10. The liquid crystal display according to claim 8, wherein a high-level of the first data output signal is maintained during a first interval prior to a second interval during an interval of one horizontal period of the source output enable signal.

11. The liquid crystal display according to claim 10, wherein a high-level of the second data output signal is maintained during the second interval.

12. The liquid crystal display according to claim 11, wherein time widths of the first and second periods are equal, and high-level widths of the first and second data output signals are equal.

13. The liquid crystal display according to claim 12, wherein the modulator outputs the modulation data during a high-level period of the first data output signal supplied for the first period and then sequentially outputs the latch data during a high-level period of the second data output signal supplied for the second period.

14. The liquid crystal display according to claim 13, wherein the modulator outputs the modulation data at a high-level period of the first data output signal supplied during the first period and then sequentially outputs the latch data at a high-level period of the second data output signal supplied during the second period.

15. The liquid crystal display according to claim 6, wherein the source signal variant portion decreases a high-level width of the source output enable signal in accordance with the data output period signal indicating an output period decrease of the modulation data to output the second variable source output enable signal to the second data output signal generator.

16. The liquid crystal display according to claim 15, wherein the second data output signal generator performs a nor operation on the first variable source output enable signal and the delay source output enable signal to output the second data output signal.

17. The liquid crystal display according to claim 16, wherein the first data output signal generator performs a nor operation on the second data output signal and the source output enable signal to output the first data output signal.

18. The liquid crystal display according to claim 17, wherein a high-level of the first data output signal is maintained during a first interval prior to a second interval during an interval of one horizontal period of the output enable signal.

19. The liquid crystal display according to claim 18, wherein a high-level of the second data output signal is maintained during the second interval.

20. The liquid crystal display according to claim 19, wherein a time width of the second period is three times as wide as a time width of the first period, and a high-level width of the second data output signal is three times as wide as a high-level width of the first data output signal.

21. An overdriving method of a liquid crystal display, comprising the steps of:

generating a source output enable signal to drive an input data; and modulating the input data, in accordance with the source output enable signal, to generate a modulation data and then sequentially outputting the modulation data and the input data, output periods of the input data and the modulation data being adjusted based on a gray scale level of the input data.

22. The overdriving method of the liquid crystal display according to claim 21, wherein the step of outputting includes:

latching the input data;

generating a data output period signal to adjust output periods of the latch data and the modulation data based on a gray scale level of the input data;

generating first and second data output signals, in response to the data output period signal and the source output enable signal, which indicate a sequential output of the modulation data and the latch data, and indicate output periods of the modulation data and the latch data;

modulating the latch data to generate the modulation data; and sequentially outputting the modulation data and the latch data in accordance with the first and second data output signals, and adjusting output periods of the modulation data and the latch data.

23. The overdriving method of the liquid crystal display according to claim 22, wherein the step of generating the data output period signal compares a gray scale level of the input data with a predetermined reference gray scale level to generate the data output period signal.

24. The overdriving method of the liquid crystal display according to claim 23, wherein if a gray scale level of the input data is higher than the predetermined reference gray scale level, the step of generating the data output period signal indicates to increase an output period of the modulation data.

25. The overdriving method of the liquid crystal display according to claim 24, wherein if a gray scale level of the input data is lower than the predetermined reference gray scale level, the step of generating the data output period signal indicates to decrease output period of the modulation data and increase the output period of the latch data.

26. The overdriving method of the liquid crystal display according to claim 22, wherein the step of generating the first and second data output signal includes:

changing a period of the source output enable signal, in accordance with the data output period signal, to generate a first variable source output enable signal or changing a high-level width of the source output enable signal to generate a second variable source output enable signal;

delaying the source output enable signal to generate a delay source output enable signal;

generating the first data output signal which indicates an output of the modulation data using the source output enable signal and the second data output signal; and generating the second data output signal which indicates an output of the latch data using the delay source output enable signal and one of the first or second variable source output enable signals.

27. The overdriving method of the liquid crystal display according to claim 26, wherein the step of changing a period of the source output enable signal generates the first variable source output enable signal when a frequency of the source output enable signal is multiplied by a factor of two in accordance with the data output period signal indicating an output period increase of the modulation data.

28. The overdriving method of the liquid crystal display according to claim 27, wherein the step of generating the second data output signal performs a nor operation on the first variable source output enable signal and the delay source output enable signal to generate the second data output signal.

29. The overdriving method of the liquid crystal display according to claim 28, wherein the step of generating the first data output signal performs a nor operation on the second data output signal and the source output enable signal to generate the first data output signal.

30. The overdriving method of the liquid crystal display according to claim 29, wherein a high-level of the first data output signal is maintained for a first interval prior to a second interval during an interval of one horizontal period of the output enable signal.

31. The overdriving method of the liquid crystal display according to claim 30, wherein a high-level of the second data output signal is maintained during the second interval.

32. The overdriving method of the liquid crystal display according to claim 31, wherein time widths of the first and second periods are equal, and high-level widths of the first and second data output signals are equal.

33. The overdriving method of the liquid crystal display according to claim 32, wherein the step of outputting the data outputs the modulation data at a high-level period of the first data output signal supplied for the first period and then sequentially outputs the latch data at a high-level period of the second data output signal supplied for the second period.

34. The overdriving method of the liquid crystal display according to claim 33, wherein the step of outputting the data outputs the modulation data at a high-level period of the first data output signal supplied during the first period and then sequentially outputs the latch data at a high-level period of the second data output signal supplied during the second period.

35. The overdriving method of the liquid crystal display according to claim 26, wherein the step of changing a period of the source output enable signal decreases a high-level width of the source output enable signal by a half width in accordance with the data output period signal indicating an output period decrease of the modulation data to generate the second variable source output enable signal.

36. The overdriving method of the liquid crystal display according to claim 35, wherein the step of generating the second data output signal performs a nor operation on the first variable source output enable signal and the delay source output enable signal to generate the second data output signal.

37. The overdriving method of the liquid crystal display according to claim 36, wherein the step of generating the first data output signal performs a nor operation on the second data output signal and the source output enable signal to generate the first data output signal.

38. The overdriving method of the liquid crystal display according to claim 37 wherein a high-level of the first data output signal is maintained for a first interval prior to a second interval during an interval of one horizontal period of the output enable signal.

39. The overdriving method of the liquid crystal display according to claim 38, wherein a high-level of the second data output signal is maintained for the second interval.

40. The overdriving method of the liquid crystal display according to claim 39, wherein a time width of the second period is three times as wide as a time width of the first period, and a high-level width of the second data output signal is three times as wide as a high-level width of the first data output signal.

41. A data driving circuit of a liquid crystal display, comprising:

a data processing means modulating an input data to generate a modulation data, and sequentially outputting the input data and the modulation data; and an output period adjusting means controlling output periods of the input data and the modulation data based on a gray scale level of the input data, the data processing means adjusting the output periods of the input data and the modulation data in accordance with a control of the output period adjusting means.

42. The data driving circuit of the liquid crystal display according to claim 41, wherein the data processing means includes:

a latch portion latching the input data; and a modulator modulating the latched data to generate a modulation data, and adjusting output periods of the input data and the modulation data in accordance with the control of the output period adjusting means.

43. The data driving circuit of the liquid crystal display according to claim 42, wherein the output period adjusting means includes:

a data output period adjusting portion generating a data output period signal to adjust output periods of a data latched by the latch portion and the modulation data based on a gray scale level of the input data; and a data output controller generating first and second data output signals, in accordance with the input source output enable signal and the data output period signal, which control a sequential output of the modulation data and the latch data, and indicate output periods of the modulation data and the latch data.

44. The data driving circuit of the liquid crystal display according to claim 43, wherein the modulator increases or decreases output periods of the modulation data and the latch data in accordance with the first and second data output signals.

45. The data driving circuit of the liquid crystal display according to claim 43, wherein the data output controller includes:

a source signal variant portion, in accordance with the data output period signal, changing a period of the source output enable signal to output a first variable source output enable signal or changing a high-level width of the source output enable signal to output a second variable source output enable signal;

a delay portion delaying a source output enable signal from the timing controller to output a delay source output enable signal;

a first data output signal generator generating the first data output signal which indicates an output of the modulation data using the source output enable signal and the second data output signal; and a second data output signal generator generating the second data output signal which indicates an output of the latch data using delay source output enable signal and one of the first and second variable source output enable signals.

46. The data driving circuit of the liquid crystal display according to claim 43, wherein if a gray scale level of the input data is higher than a predetermined reference gray scale level, the modulator increases an output period of the modulation data, and decreases an output period of the latched data.

47. The data driving circuit of the liquid crystal display according to claim 43, wherein if a gray scale level of the input data is lower than a predetermined reference gray scale level, the modulator decreases an output period of the modulation data and increases an output period of the latched data.

48. A method of driving a data of a liquid crystal display, comprising the steps of:

modulating an input data to generate a modulation data; and sequentially outputting the input data and the modulation data, the output periods of the input data and the modulation data being adjusted based on a gray scale level of the input data in the step of outputting the modulation data and the input data.

49. The method of driving the data of the liquid crystal display according to claim 48, wherein the step of generating includes:

latching the input data; and modulating the latched data to generate a modulation data.

50. The method of driving the data of the liquid crystal display according to claim 49, wherein the step of outputting includes:

generating a data output period signal to adjust output periods of the latched data and the modulation data based on a gray scale level of the input data;

generating first and second data output signals, in accordance with the input source output enable signal and the data output period signal, which control a sequential output of the modulation data and the latch data, and indicates output periods of the modulation data and the latch data; and adjusting output periods of the modulation data and the latch data in accordance with the first and second data output signals.

51. The method of driving the data of the liquid crystal display according to claim 50, wherein the step of generating the first and second data output signals includes:

changing a period of the source output enable signal, in accordance with the data output period signal, to generate a first variable source output enable signal or changing a high-level width of the source output enable signal to generate a second variable source output enable signal;

delaying the input source output enable signal to generate a delay source output enable signal;

generating the first data output signal which indicates an output of the modulation data using the input source output enable signal and the second data output signal; and generating the second data output signal which indicates an output of the latch data using the delay source output enable signal and one of the first and second variable source output enable signals.

52. The method of driving the data of the liquid crystal display according to claim 50, wherein if a gray scale level of the input data is higher than a predetermined reference gray scale level, the step of adjusting the output periods increases an output period of the modulation data, and decreases an output period of the latched data.

53. The method of driving the data of the liquid crystal display according to claim 50, wherein if a gray scale level of the input data is lower than a predetermined reference gray scale level, the step of adjusting the output periods decreases an output period of the modulation data, and increases an output period of the latched data.

* * * * *